US007244155B1

(12) United States Patent
Nye et al.

(10) Patent No.: US 7,244,155 B1
(45) Date of Patent: Jul. 17, 2007

(54) MOORING LINE FOR AN OCEANOGRAPHIC BUOY SYSTEM

(75) Inventors: Richard E. Nye, Tully, NY (US); Hugh B. Milburn, Lake Forest Park, WA (US)

(73) Assignee: Cortland Cable Company, Inc., Cortland, NY (US)

( * ) Notice: Subject to any disclaimer, the term of this patent is extended or adjusted under 35 U.S.C. 154(b) by 0 days.

(21) Appl. No.: 11/507,176

(22) Filed: Aug. 21, 2006

(51) Int. Cl.
*B63B 22/18* (2006.01)

(52) U.S. Cl. ..... 441/23; 87/6

(58) Field of Classification Search ..... 441/23; 174/101.5; 87/5–7; 114/293, 230.2
See application file for complete search history.

(56) References Cited

U.S. PATENT DOCUMENTS 3,423,777 A 1/1969 Feyling
3,590,408 A 7/1971 Verhagen
3,605,398 A * 9/1971 Carlson et al. ..... 57/217
3,728,748 A 4/1973 Roehler, II
3,742,535 A 7/1973 Horrer et al.
3,950,806 A 4/1976 Puchois
4,216,535 A 8/1980 Bennett
4,498,877 A 2/1985 Rademakers
4,534,262 A 8/1985 Swenson
4,640,212 A 2/1987 Brandt
5,054,415 A * 10/1991 Marshall ..... 114/293
5,129,848 A 7/1992 Etheridge et al.
H1650 H 6/1997 Olson
6,085,628 A * 7/2000 Street et al. ..... 87/7
6,575,072 B2 6/2003 Pellerin

* cited by examiner

*Primary Examiner*—Ed Swinehart
(74) *Attorney, Agent, or Firm*—Hammer & Hanf, P.C.

(57) ABSTRACT

A mooring line for an oceanographic buoy system includes four sections. The first section is a protected cable that is connectable to the buoy. The second section is an energy absorbing cable. The third section is a weighted cable. The fourth section is a buoyant cable that is connectable to the anchor. The four sections are connected in series by smooth transitional connections. When the mooring line is deployed, it has an inverse catenary lay.

26 Claims, 1 Drawing Sheet

MOORING LINE FOR AN OCEANOGRAPHIC BUOY SYSTEM

FIELD OF INVENTION

The instant application relates to a mooring line for an oceanographic buoy system.

BACKGROUND OF THE INVENTION

A mooring line for an oceanographic buoy system is a line that secures a buoy in place in the ocean. The simplest method for a mooring line is to secure one end of a simple rope or cable to the buoy and securing the other end to an anchor or fixed point under the water. Although this is effective under some circumstances, a simple rope or cable for a mooring line will fail under certain ocean conditions.

There are numerous buoy system designs available, but buoy systems can be broadly categorized into surface or subsurface, or a combination of the two. Surface buoy systems are used to secure floating platforms that can be meteorological, as well as oceanographic. Subsurface buoy systems secure instrumentation in place in the water or on the bottom. Buoy systems can also be built to include a combination of surface data collection and subsurface instrumentation integrated into the mooring line. Exemplary studies may include: wind speed and direction, barometric pressure, air and water temperature, solar radiation, rainfall, visibility, etc. Many buoys also measure wave parameters by either wave height or wave direction, or both.

Mooring lines for an oceanographic buoy system come in many different shapes, sizes, and materials. Optimum design of a mooring line for an oceanographic buoy system is dependant on several factors, including functional requirements, water depth, currents, tides, waves, vessel traffic, and fish bite in the vicinity of the oceanographic buoy system.

Current mooring lines for an oceanographic buoy system are made up of many discrete sections of line that may include wire rope and various types of synthetic lines. These lines can either be taut or slack. Taut lines for oceanographic buoy systems have to be made of very elastic material and normally have to be replaced often. Slack lines typically use an 'inverted catenary' or 'S tether' design. This type of mooring line includes a buoyant section of line, or attached floats, above the anchor to keep the line off the bottom, and top sections that are negatively buoyant, made of wire or a synthetic product. Both of these types of mooring lines may include a synthetic section which stretches, allowing for more durability than a common rope or cable.

There are many problems with the current design of mooring lines for oceanographic buoy systems. Although the current designs are more durable than a simple rope or cable, they still are exposed to constant changes in currents, waves, and other environmental factors, that require these lines to be replaced over frequent periods of time.

Another problem with the current mooring lines is how they are deployed. The current designs of such mooring lines include different sections of line that are not put together until they are deployed. These sections of line are loaded and carried on a vessel on separate wooden or steel reels and the sections are shackled together as the line is played out over the vessel. Buoy systems can be deployed anywhere and at any time in the ocean where the seas can be rough and very unpredictable. This process of shackling the sections of line together is very dangerous in the unpredictable seas and can lead to injuries and loss of equipment.

The instant invention is designed to address these problems.

SUMMARY OF THE INVENTION

The instant invention is a mooring line for an oceanographic buoy system. The mooring line includes four sections. The first section is a protected cable that is connectable to the buoy. The second section is an energy absorbing cable. The third section is a weighted cable. The fourth section is a buoyant cable that is connectable to the anchor. The four sections are connected in series by smooth transitional connections. When the mooring line is deployed, it has an inverse catenary lay.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
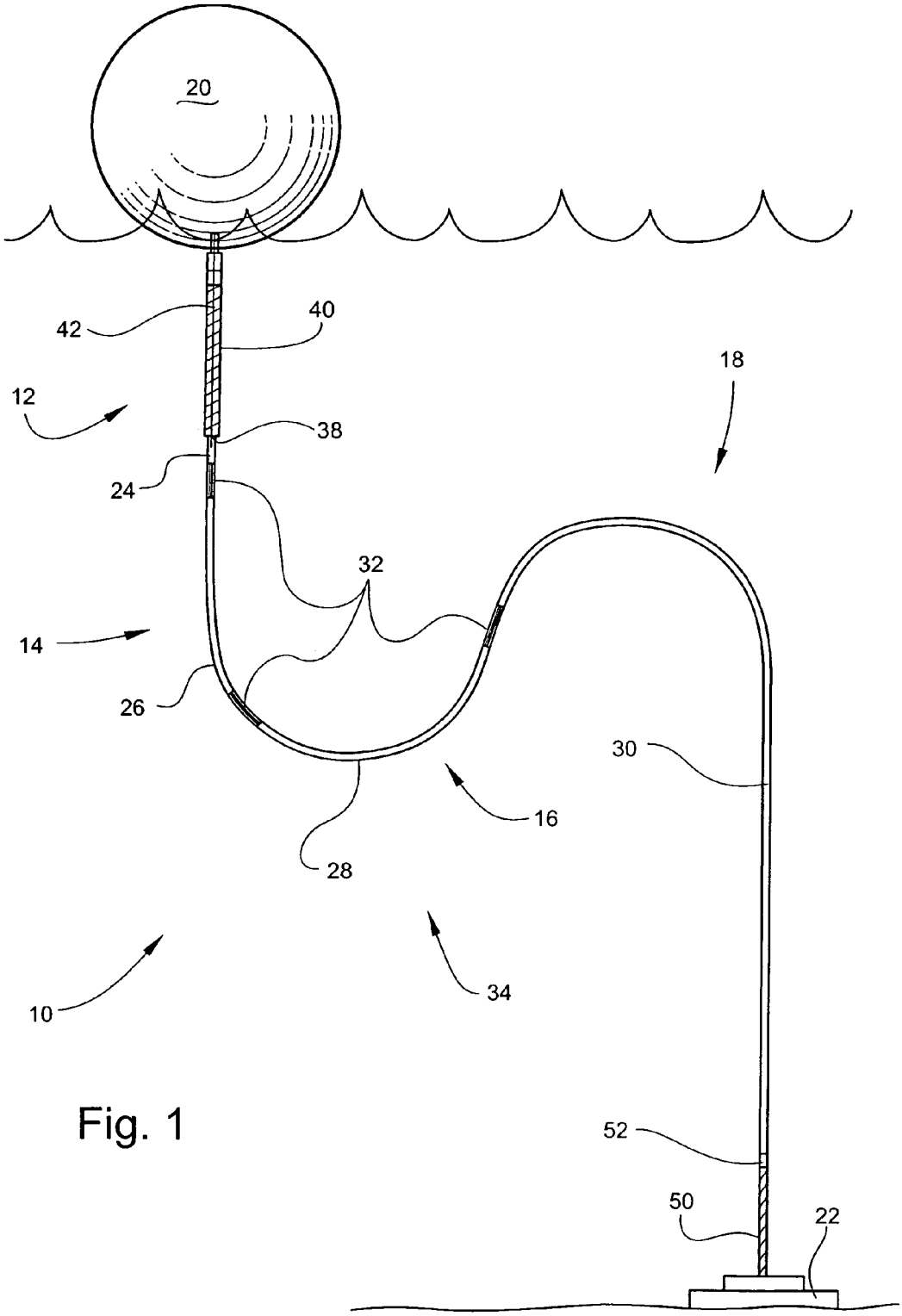
FIG. 1 is one embodiment of the mooring line.

Referring to the drawing, wherein like numerals indicate like elements, there is shown in FIG. 1 an embodiment of a mooring line 10 for an oceanographic buoy system. Mooring line 10 generally comprises a first section 12, a second section 14, a third section 16, and a fourth section 18. The four sections may be connected in series by a smooth transitional connection 32. The oceanographic buoy system may have a buoy 20 and an anchor 22. Mooring line 10 may be any length for securing oceanographic buoy 20 to anchor 22 at various depths in the ocean. When deployed, mooring line 10 may form an inverse catenary lay 34.

Smooth transitional connections 32 may be included in mooring line 10 (see FIG. 1). Smooth transitional connections 32 may be for connecting the four sections in series so that the sections are smooth from one section to the next. Smooth transitional connections 32 may be any connection capable of connecting the four sections in series so that the sections are smooth from one section to the next. For example, smooth transitional connections 32 may be smooth transitional machine splices, or braider splices, as commonly know in the art. Smooth transitional connections 32 may allow for mooring line 10 to be rolled up on a continuous reel or box that prevents mooring line 10 from having to be shackled together as it is payed out of a vessel.

Inverse catenary lay 34 may be the shape mooring line 10 takes when mooring line 10 may be deployed (see FIG. 1). Inverse catenary lay 34 may be for allowing mooring line 10 to store length for the various depths of the ocean. Inverse catenary lay 34 may be for preventing mooring line 10 from sinking to the bottom and fouling up from rubbing on anchor 22 or the ocean bottom.

Buoy 20 may be included in the oceanographic buoy system (see FIG. 1). Buoy 20 may be for providing a location on the water surface. Buoy 20 may be any buoy capable of providing a location on the water surface. Buoy 20 may be connectable to mooring line 10. Buoy 20 may be for providing oceanographic and/or meteorological data. Buoy 20 may be any standard buoy.

Anchor 22 may be included in the oceanographic buoy system (see FIG. 1). Anchor 22 may be for maintaining a location on the ocean bottom. Anchor 22 may be any device capable of maintaining a location on the ocean bottom. Anchor 22 may be attachable to mooring line 10 through chafe resistant cable 50. Anchor 22 may be the anchor used for any standard buoy systems.

First section 12 may be the first section of four sections in series of mooring line 10 (see FIG. 1). First section 12 may be connectable at one end to buoy 20. First section 12 may be connected at the other end to second section 14 by smooth transitional connection 32. First section 12 may be for protecting mooring line 10 from the environment near the top of the ocean. First section 12 may be designed at any length. First section 12 may comprise a protected cable 24. First section 12 may further comprise a fish bite protection 38 over protected cable 24. First section 12 may further comprise a strum protection 40 over protected cable 24. First section 10 may further comprise a conductor 42.

Protected cable 24 may be included in first section 12 (see FIG. 1). Protected cable 24 may be for providing a core for first section 12. Protected cable 24 may be any length, including, but not limited to, seven hundred (700) meters long. Protected cable 24 may be of any strength, including, but not limited to, a rated breaking strength between twelve hundred (1200) pounds and twelve thousand (12,000) pounds. Protected cable 24 may be a polyester cable. The polyester cable may be any polyester cable. As an example, the polyester cable may be seven hundred (700) meters of 12 (twelve) strand polyester with a rated breaking strength of seventy five hundred (7500) pounds. Protected cable 24 may be made of any type of material, including, but not limited to polyester or aramid fibers. Protected cable 24 may be a VECTRAN® cable. As an example, the VECTRAN® cable may be, but is not limited to, seven hundred (700) meters of 12 (twelve) strand VECTRAN® with a rated breaking strength of thirty four hundred (3400) pounds. VECTRAN® is a fiber with a registered trademark by the Celanese Corporation.

Fish bite protection 38 may be included in first section 12 (see FIG. 1). Fish-bite protection 38 may be over protected cable 24. Fish bite protection 38 may be for protecting protected cable 24 from fish bites. Fish bite protection 38 may be anything over protected cable 24 capable of protecting protected cable 24 from fish bites. Fish bite protection 38 may be a non-conducting material over protected cable 24. Fish bite protection 38 may be made of any material capable of withstanding random strikes by four (4) to six (6) foot typical warm water sharks without damaging the fibers of protected cable 24. Fish bite protection may be thin strips of material that are helixed around protected cable 24. Fish bite protection 38 may be, but is not limited to, a woven fabric of aramid fiber with a ceramic coating.

Strum protection 40 may be included in first section 12 (see FIG. 1). Strum protection 40 may be over protected cable 24. Strum protection 40 may be for reducing the vortex induced vibration from the movement of the ocean. Strum protection 40 may be anything over protected cable 24 capable of reducing the vortex induced vibration from the movement of the ocean. Strum protection 40 may be a polyurethane jacket with external ridges. The external ridges of the polyurethane jacket may be random anti-strumming strakes. The polyurethane jacket with external ridges may be any length, including, but not limited to, six hundred and fifty (650) meters long. The outside diameter of the polyurethane jacket with external ridges may be any diameter, including but not limited to, seven tenths (0.7) of an inch or less.

Conductor 42 may be included in first section 12 (see FIG. 1). Conductor 42 may be for transmitting signals through mooring line 10 to buoy 20. Conductor 42 may be any device capable of transmitting a signal through mooring line 10 to buoy 20. Conductor 42 may be inserted below strum protection 40. Conductor 42 may be a wire with a proven ability to withstand bending and elongation of up to fifteen (15) percent without failure. Conductor 42 may be any length. Preferably, conductor 42 may extend from one (1) meter above strum protection 40 to two (2) meters below strum protection 40. As an example, conductor 42 may be jacketed eighteen (18) to twenty two (22) gage silver plated copper wire wound on a high helix angle over an internal core and then jacketed.

Second section 14 may be the second section in a series of four of mooring line 10 (see FIG. 1). Second section 14 may be connected at one end to first section 12 by smooth transitional connection 32. Second section 14 may be connected at the other end to third section 16 by smooth transitional connection 32. Second section 14 may be for providing the necessary energy absorption to mooring line 10. Second section 14 may be any length. Second section 14 may comprise an energy absorbing cable 26.

Energy absorbing cable 26 may be included in second section 14 (see FIG. 1). Energy absorbing cable 26 may be for providing the necessary energy absorption to mooring line 10. Energy absorbing cable 26 may be any cable capable of providing the necessary energy absorption to mooring line 10. Energy absorbing cable 26 may give the desired extension of mooring line 10 which may allow mooring line 10 to increase length under high loads and may reduce the dynamic tensions at the buoy as shown by mooring line models. Energy absorbing cable 26 may have any strength, including, but not limited to, a rated breaking strength between three thousand (3000) and seventy five hundred (7500) pounds. Energy absorbing cable may be any length, for example, three hundred (300) meters long. Energy absorption cable 26 may be a nylon cable. The nominal diameter of the nylon cable may be less than five tenths (0.5) of an inch. As an example, the nylon cable may be twelve (12) strand nylon with a rated breaking strength between three thousand (3000) and seventy five hundred (7500) pounds.

Third section 16 may be the third section in a series of four of mooring line 10 (see FIG. 1). Third section 16 may be connected at one end to second section 14 by smooth transitional connection 32. Third section 16 may be connected at the other end to fourth section 18 by smooth transitional connection 32. Third section 16 may be for providing a weighted section to mooring line 10. Third section 16 may be any length. Third section 16 may comprise a weighted cable 28.

Weighted cable 28 may be included in third section 16 (see FIG. 1). Weighted cable 28 may be for providing the necessary weight to mooring line 10 to form inverse catenary lay 34. Weighted cable 28 may be any cable capable of providing the necessary weight to mooring line 10 to form inverse catenary lay 34. Weighted cable 28 may have distributed weight along a significant section to aid in the load and catenary shape of mooring line 10. Weighted cable 28 may be capable of withstanding millions of cycles in the wave fields and not foul or chafe. Weighted cable 28 may be any length. Weighted cable 28 may have any strength, including, but not limited to, a rated breaking strength between twenty eight hundred (2800) pounds and seven thousand (7000) pounds. Weighted cable 28 may be a weighted polyester cable. The weighted polyester cable may have seventy five (75) to one hundred (100) pounds of evenly distributed weight. The weighted polyester cable may have a lead line in its core for adding seventy five (75) to one hundred (100) pounds of evenly distributed weight. The weighted polyester cable may have a length of over fifty meters (50). For example, the weighted polyester cable may be twelve (12) strand polyester with a rated breaking strength of seven thousand (7000) pounds and a nominal diameter of approximately forty three hundredths (0.43) of an inch. As another example, the weighted polyester cable may be twelve (12) stand polyester with a rated breaking strength of twenty eight hundred (2800) pounds and a nominal diameter of approximately twenty eight hundredths (0.28) of an inch.

Fourth section 18 may be the fourth section in a series of four of mooring line 10 (see FIG. 1). Fourth section 18 may be connected at one end to third section 16 by smooth transitional connection 32. Fourth section 18 may be connectable at the other end to anchor 22. Fourth section 18 may be connectable to anchor 22 through a chafe resistant cable 48. Fourth section 18 may be for providing a buoyant section to mooring line 10. Fourth section 18 may be any length. Fourth section 18 may comprise a buoyant cable 28.

Buoyant cable 28 may be included in fourth section 18 (see FIG. 1). Buoyant cable 28 may be for providing the necessary buoyancy for mooring line 10 to form inverse catenary lay 34. Buoyant cable 28 may be any cable capable of providing the necessary buoyancy for mooring line 10 to form inverse catenary lay 34. Buoyant cable 28 may provide a specific gravity of ninety four one hundredths (0.94) or less. Buoyant cable 28 may have any rated breaking strength, including but not limited to, a rated breaking strength between twenty eight hundred (2800) pounds and six thousand (6000) pounds. Buoyant cable 28 may be a copolymer cable. As an example, the copolymer cable may be twelve (12) strand copolymer with a rated breaking strength of six thousand (6000) pounds and a nominal diameter of five tenths (0.5) of an inch. As another example, the copolymer cable may be twelve (12) strand copolymer with a rated breaking strength of twenty eight hundred (2800) pounds and a nominal diameter of approximately three tenths (0.3) of an inch.

Chafe resistant cable 50 may connect fourth section 18 to anchor 22 (see FIG. 1). Chafe resistant cable 50 may be for connecting mooring line 10 to anchor 22 so that anchor 22 may not chafe mooring line 10. Chafe resistant cable 50 may be any cable capable of connecting mooring line 10 to anchor 22 so that anchor 22 may not chafe mooring line 10. Preferably, chafe resistant cable 22 may have a high strength to prevent anchor 22 from chafing mooring line 10. Chafe resistant cable 22 may be connected to fourth section 18 by tuck splice 52. Chafe resistant cable 22 may be any length. As an example, chafe resistant cable 22 may be ten (10) meters of twelve (12) strand polyester that has a diameter between six tenths (0.6) of an inch and seventy five hundredths (0.75) inch.

Tuck splice 52 may be included in mooring line 10 (see FIG. 1). Tuck splice 52 may be for connecting fourth section 18 to chafe resistant cable 50. Tuck splice 52 may be any device capable of connecting fourth section 18 to chafe resistant cable 50. Tuck splice 52 may be a standard tuck splice, as commonly known in the art.

Mooring line 10 may be made with different lengths of the four sections to allow mooring line 10 to be used in an oceanographic buoy system in various depths of the ocean. Mooring line 10 must be designed to fit the depth of the ocean at the point where the oceanographic buoy system is to be positioned to function properly. The following Length Configuration chart represents functional lengths in meters of the four sections of mooring line 10 at various depths:

| | Example Lengths Length Configuration (meters) Nominal Scope = 1.15 | | | | |
|---|---|---|---|---|---|
| Depth | 3000 | 3400 | 4000 | 4700 | 5500 |
| Section one | 700 | 700 | 700 | 700 | 700 |
| Section two | 300 | 300 | 300 | 300 | 300 |
| Section three | 1070 | 1346 | 1760 | 2243 | 2795 |
| Section four | 1380 | 1564 | 1840 | 2162 | 2530 |
| Overall Length | 3450 | 3910 | 4600 | 5405 | 6325 |

Once the lengths are determined, the sections may be connected in series using smooth transitional connections 32. The smooth transitional connections 32 may allow mooring line 10 to be rolled on to a continuous reel or box which may be loaded onto a vessel. The vessel (ship or aircraft) may carry the reel or box out to the destination where the oceanographic buoy system may be deployed. Once to the destination, the oceanographic buoy system may be deployed without having to shackle the different sections together, thus, reducing the danger of injuries and loss of equipment.

When deployed, mooring line 10 may connect buoy 20 to anchor 22. Mooring line 10 may have inverse catenary lay 34. Inverse catenary lay 34 may be formed by the combination of third section 16 having weighted cable 28 and fourth section 18 having a buoyant cable 30. Weighted cable 28 provides a downward force and buoyant cable 30 provides an upward force in the water which provides the forces necessary for inverse catenary lay 34. Inverse catenary lay 34 may allow mooring line 10 to store length without allowing mooring line 10 to sink to the bottom. This may prevent mooring line 10 from fouling up on anchor 22 or the ocean bottom. Thus, mooring line 10 may provide a form of a slack line which may prolong the life of mooring line 10.

When mooring line 10 may be in use, fish bite protection 38 may prevent mooring line 10 from being severed or worn down by fish bite near the surface of buoy 20. Also, when mooring line 10 may be in use, strum protection 40 may reduce tensions in mooring line 10 near the surface of buoy 20. Also, when mooring line 10 may be in use, energy absorbing cable 26 may provide an elastic section of mooring line 10, which may reduce the forces applied on the other sections of mooring line 10. Thus, mooring line 10 may provide a mooring line with a prolonged life.

The present invention may be embodied in other forms without departing from the spirit and the essential attributes thereof, and, accordingly, reference should be made to the appended claims, rather than to the foregoing specification, as indicated in the scope of the invention.

We claim:

1. A mooring line for an oceanographic buoy system having a buoy and an anchor comprising:

a first section comprising a protected cable and being connectable to said buoy;

a second section comprising an energy absorbing cable;

a third section comprising a weighted cable; and a fourth section comprising a buoyant cable and being connectable to said anchor;

where said sections being connected in series by a smooth transitional connection; and when said mooring line being deployed, said mooring line securing said buoy to said anchor and having an inverse catenary lay.

2. The mooring line of claim 1 wherein said smooth transitional connections being smooth transitional machine splices.

3. The mooring line of claim 1 where said protected cable comprising a polyester cable.

4. The mooring line of claim 3 where said polyester cable being seven hundred (700) meters of twelve (12) strand polyester with a rated breaking strength of seventy five hundred (7500) pounds.

5. The mooring line of claim 1 where said protected cable comprising a cable constructed from a liquid crystal polymer.

6. The mooring line of claim 5 where said cable being seven hundred (700) meters long of 12 (twelve) strands with a rated breaking strength of thirty four hundred (3400) pounds.

7. The mooring line of claim 1 where said first section further comprising a fish bite protection.

8. The mooring line of claim 7 where said fish bite protection being a non conducting material over said protected cable with a proven capability to withstand random strikes by four (4) to six (6) foot typical warm water sharks without damaging the fibers of said protected cable.

9. The mooring line of claim 1 where said first section further comprising a strum protection.

10. The mooring line of claim 9 where said strum protection being a polyurethane jacket over said protected cable with external ridges.

11. The mooring line of claim 10 where said polyurethane jacket being six hundred and fifty (650) meters long with an outside diameter of seven tenths (0.70) inches or less, where said polyurethane jacket being positioned over said protected cable.

12. The mooring line of claim 1 where said first section further comprising a conductor.

13. The mooring line of claim 12 where said conductor being a wire with a capability to withstand repeated bending and elongation of up to fifteen (15) percent.

14. The mooring line of claim 13 where said conductor being an eighteen (18) to twenty two (22) gage silver plated copper wire extending one (1) meter from the top of said first section and two (2) meters below said polyurethane jacket.

15. The mooring line of claim 1 where said energy absorbing cable being a nylon cable.

16. The mooring line of claim 15 where said nylon cable being three hundred (300) meters of twelve (12) strand nylon with a rated breaking strength between three thousand (3000) pounds and seventy five hundred (7500) pounds and a nominal diameter of five tenths (0.5) of an inch or less.

17. The mooring line of claim 1 wherein said weighted cable being a weighted polyester cable.

18. The mooring line of claim 17 where said weighted polyester cable being fifty (50) meters or more of twelve (12) strand polyester with a rated breaking strength between twenty eight hundred (2800) pounds and seven thousand (7000) pounds, a weight of seventy five (75) to one hundred (100) pounds evenly distributed, and a nominal diameter between twenty eight hundredths (0.28) of an inch and forty three hundredths (0.43) of an inch.

19. The mooring line of claim 18 where said weighted polyester cable comprising a lead line in its core, where said lead line providing seventy five (75) to one hundred (100) pounds evenly distributed weight.

20. The mooring line of claim 1 where said buoyant cable having a specific gravity of ninety four hundredths (0.94) or less.

21. The mooring line of claim 20 where said buoyant cable being a copolymer cable.

22. The mooring line of claim 21 where said copolymer cable being twelve (12) strand copolymer with a rated breaking strength between twenty eight hundred (2800) pounds and six thousand (6000) pounds and a nominal diameter of five tenths (0.5) of an inch or less.

23. The mooring line of claim 1 where said fourth section being connected to the anchor by a chafe resistant cable.

24. The mooring line of claim 23 where said chafe resistant cable being ten (10) meters of twelve (12) strand polyester with a diameter between six tenths (0.6) of an inch and seventy five one hundredths (0.75) of an inch.

25. The mooring line of claim 23 where said chafe resistant cable and said fourth section being connected by a tuck splice.

26. The mooring line of claim 1 wherein said smooth transitional connections being smooth transitional machine splices.

* * * * *

UNITED STATES PATENT AND TRADEMARK OFFICE

CERTIFICATE OF CORRECTION

PATENT NO. : 7,244,155 B1
APPLICATION NO. : 11/507176
DATED : July 17, 2007
INVENTOR(S) : Richard E. Nye, Hugh B. Milburn and Christian Meinig It is certified that error appears in the above-identified patent and that said Letters Patent is hereby corrected as shown below:

On title page, item 75 Inventors,
Add inventor "Christian Meinig, Seattle, WA (US)"

Signed and Sealed this

Seventeenth Day of March, 2009

John Doll

JOHN DOLL
*Acting Director of the United States Patent and Trademark Office*